US008439055B2

(12) United States Patent
April et al.

(10) Patent No.: US 8,439,055 B2
(45) Date of Patent: May 14, 2013

(54) ADJUSTABLE UMBRELLA FOR STROLLER

(76) Inventors: Melissa April, Philadelphia, PA (US); Caryn Abramowitz, Philadelphia, PA (US)

( * ) Notice: Subject to any disclaimer, the term of this patent is extended or adjusted under 35 U.S.C. 154(b) by 0 days.

(21) Appl. No.: 13/009,124

(22) Filed: Jan. 19, 2011

(65) Prior Publication Data

US 2012/0180831 A1 Jul. 19, 2012

(51) Int. Cl.
*A45B 11/00* (2006.01)
*A45B 3/00* (2006.01)

(52) U.S. Cl.
USPC ..... 135/16; 135/20.3; 135/88.02; 280/47.38; 297/184.16; 248/514

(58) Field of Classification Search ..... 135/15.1, 135/16, 20.3, 21, 25.4, 88.01–88.02, 4; 297/184.1, 297/184.16; 296/77.1; 280/47.38, 647; 248/513–514, 248/229.1
See application file for complete search history.

(56) References Cited

U.S. PATENT DOCUMENTS

| | | | | |
|---|---|---|---|---|
| 970,751 | A * | 9/1910 | Pranke | 248/515 |
| 3,148,851 | A * | 9/1964 | Condon | 248/515 |
| 3,304,036 | A * | 2/1967 | Davis | 248/514 |
| 4,747,569 | A * | 5/1988 | Hoshino | 248/291.1 |
| 4,919,379 | A | 4/1990 | Goetz | |
| 5,878,762 | A * | 3/1999 | Huang | 135/16 |
| 5,921,258 | A * | 7/1999 | Francois | 135/88.03 |
| 6,244,557 | B1 | 6/2001 | Maze | |
| 6,405,742 | B1 * | 6/2002 | Driscoll | 135/96 |
| 6,533,237 | B1 * | 3/2003 | Matusek | 248/514 |
| 6,899,388 | B1 * | 5/2005 | Enrique | 297/184.16 |
| 7,493,908 | B2 | 2/2009 | Carter et al. | |
| 8,091,962 | B2 * | 1/2012 | Quinn | 297/184.16 |

FOREIGN PATENT DOCUMENTS

GB 2277955 A * 11/1994

* cited by examiner

*Primary Examiner* — Winnie Yip
(74) *Attorney, Agent, or Firm* — Eckert Seamans Cherin & Mellott, LLC; Stephen A. Bucchianeri

(57) ABSTRACT

An umbrella assembly for providing cover to a user pushing a stroller or similar device includes a clamp mechanism structured to be coupled to a portion of the stroller and an umbrella portion selectively coupled to the clamp mechanism. The umbrella portion is selectively rotatable relative to the clamp mechanism among a plurality of positions.

3 Claims, 4 Drawing Sheets

ADJUSTABLE UMBRELLA FOR STROLLER

BACKGROUND OF THE INVENTION

1. Field of the Invention

The present invention relates to an adjustable mounting device for securing an umbrella to a stroller, carriage, pram, walker, wheelchair or other such device to provide protection from environmental conditions to an individual pushing the device, without requiring use of a hand to hold the umbrella.

2. Description of Related Art

Baby strollers often come equipped with canopies and rain covers that protect the child from environmental conditions such as sun and rain. The person pushing the stroller, hereinafter referred to as "a user", however, is not provided such protection and as such often must hold an umbrella separately, in addition to pushing the stroller. Due to size and other design characteristics, many strollers require two hands to steer properly, so a rainstorm or other such event can provide a frustrating experience to the parent or other individual wheeling the stroller through inclement weather.

Other patents have discussed mechanisms for attaching an umbrella or parasol to a baby carriage or stroller. For example, U.S. Pat. No. 7,493,908 (Carter) relates to an umbrella anchored to a stroller by a guy line or guy lines, belt or buckle. Such method of attachment does not address the critical problem of keeping the umbrella stable and upright while in motion. Such method also does not effectively take into account the direction of the rain or the height of the user.

U.S. Pat. No. 6,244,557 (Maze) relates to a bridging mechanism to attach to two spaced handlebars of a stroller. The application of such mechanism is very limited. For example, the mechanism is not useable on the multitude of strollers that contain a single handlebar, does not permit maneuverability of the umbrella, and does not allow for stowability on the stroller.

U.S. Pat. No. 4,919,379 (Goetz) relates to a clamping fixture for attaching umbrellas, parasols, sunscreens and the like to baby carriages or strollers. Such device is intended exclusively to protect the child seated in the stroller and does not address the problem of keeping the user dry in a rainstorm, or the awkwardness of trying to push a stroller on a rainy day, while holding an umbrella. Such device also does not provide adjustability for position or height.

Accordingly, there is room for improvement in mechanisms for providing an umbrella to a user of a stroller.

SUMMARY OF THE INVENTION

In view of the foregoing disadvantages inherent in the known types of umbrella holding methods now present in the prior art, the present invention provides a new umbrella mounting device for a stroller wherein the same can be utilized for protecting the user of a stroller from inclement weather.

In one embodiment of the invention, an umbrella assembly for providing cover to a user pushing a stroller or similar device is provided. The assembly includes a clamp mechanism structured to be coupled to a portion of the stroller and an umbrella portion selectively coupled to the clamp mechanism. The umbrella portion is selectively rotatable relative to the clamp mechanism among a plurality of positions.

The umbrella portion may be moveable among the plurality of positions while coupled to the clamp. The plurality of positions may comprise a first position in which the umbrella is structured to be positioned generally above the user and a second position in which the umbrella portion has been rotated about 180° downward from the first position. The clamp mechanism may comprise a first knob and a second knob, the first knob being structured to tighten or loosen the clamp mechanism from the stroller and the second knob being disposed to adjust the coupling of the umbrella portion and the clamp member. The umbrella portion may comprise a telescoping shaft having a lower portion and an upper portion, the lower portion having a number of apertures disposed therein and the upper portion having a button member protruding radially therefrom. The button member may be structured to selectively engage a selected one of the number of apertures in a manner that allows for the relative positioning of the lower portion and the upper portion to be selectively adjusted.

In another embodiment of the invention, another umbrella assembly for providing cover to a user pushing a stroller or similar device is also provided. The assembly includes an umbrella having a shaft extending therefrom and a clamp mechanism having a first portion structured to be coupled to a portion of the stroller and a second portion coupled to the shaft of the umbrella. The second portion of the clamp mechanism is selectively rotatable about the first portion of the clamp mechanism such that the umbrella may be placed among a plurality of positions.

The second portion of the clamp mechanism may be selectively rotatable with respect to the first portion of the clamp mechanism from a first position to a second position about 180 degrees from the first position. The first portion of the clamp mechanism may comprise a first knob that is structured to tighten or loosen the coupling of the first portion and the portion of the stroller. The second portion of the clamp mechanism may comprise a second knob member that is structured to control rotation of the second portion about the first portion. The second portion of the clamp mechanism may comprise a hollow shaft that slidably engages the shaft of the umbrella. The hollow shaft may comprise a number of apertures disposed therein and the shaft of the umbrella may comprise a button member protruding radially therefrom, the button member being structured to selectively engage a selected one of the number of apertures in a manner that allows for the relative positioning of the shaft of the umbrella within the hollow shaft of the second portion to be selectively adjusted.

It is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The foregoing and other features and advantages of the invention will become apparent upon reading the following detailed description of the invention in conjunction with the attached drawings in which.

DETAILED DESCRIPTION OF THE PREFERRED EMBODIMENTS

Figure 1:
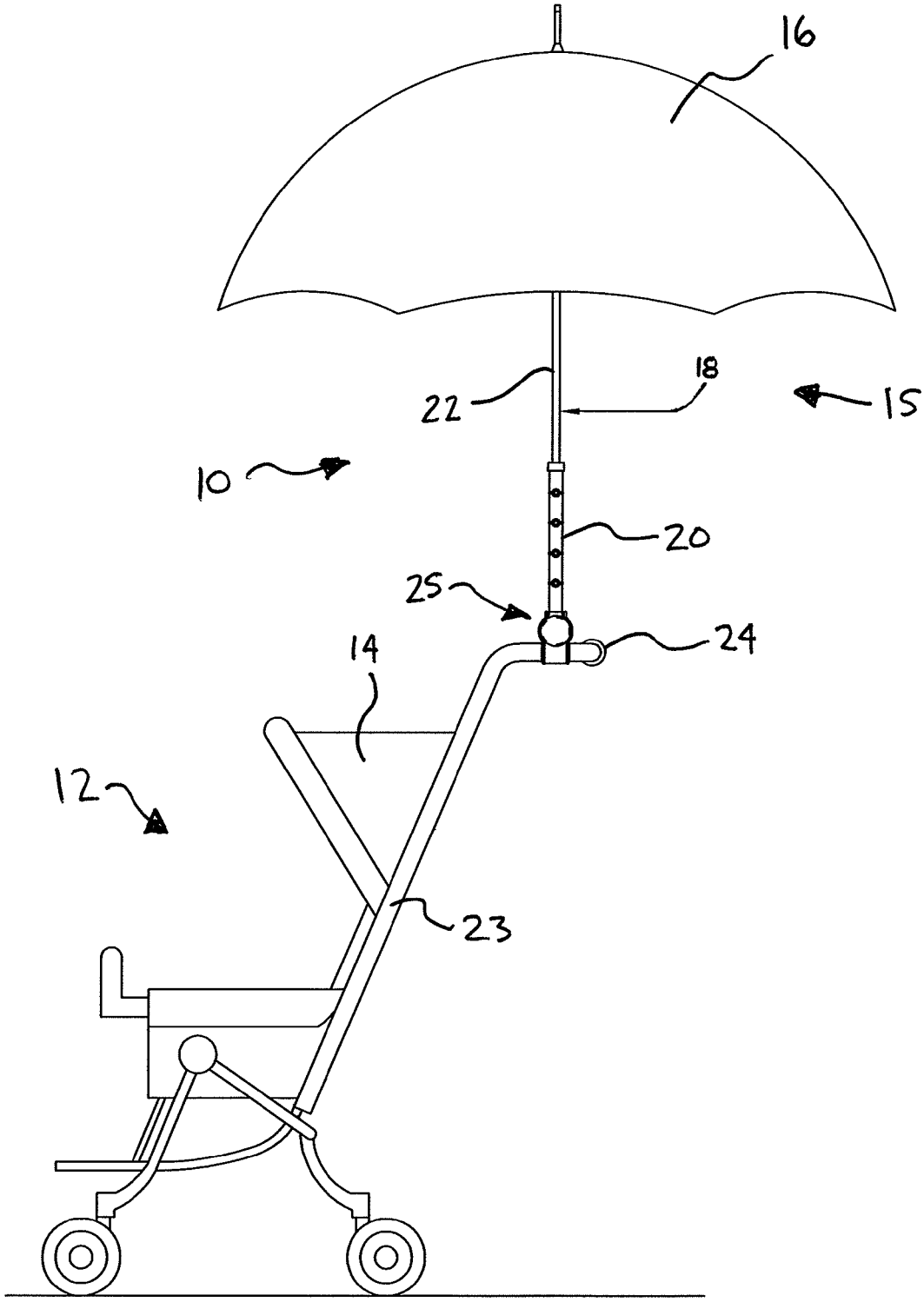
FIG. 1 is a side elevational view of a non-limiting embodiment of the present invention installed on an example stroller with the umbrella portion positioned in an active position.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

In addressing deficiencies of known designs, embodiments of the present invention provide a mounting device that attaches securely and easily to a stroller, carriage, pram, walker, wheelchair or other pushchair. As employed herein, the term "stroller" shall be used to mean a stroller, carriage, pram, walker, wheelchair or other similar device. It is a further object of the invention to provide an umbrella suitable for attachment to the mounting device that works on strollers, wheelchairs and walkers, and protects users of virtually all heights from all directions of rain. In these respects, the umbrella mounting device for a stroller, according to the present invention, substantially departs from the conventional concepts and designs of the prior art, and in doing so, provides an apparatus primarily developed for purposes of protecting the user of the stroller from inclement weather.

Figure 2:
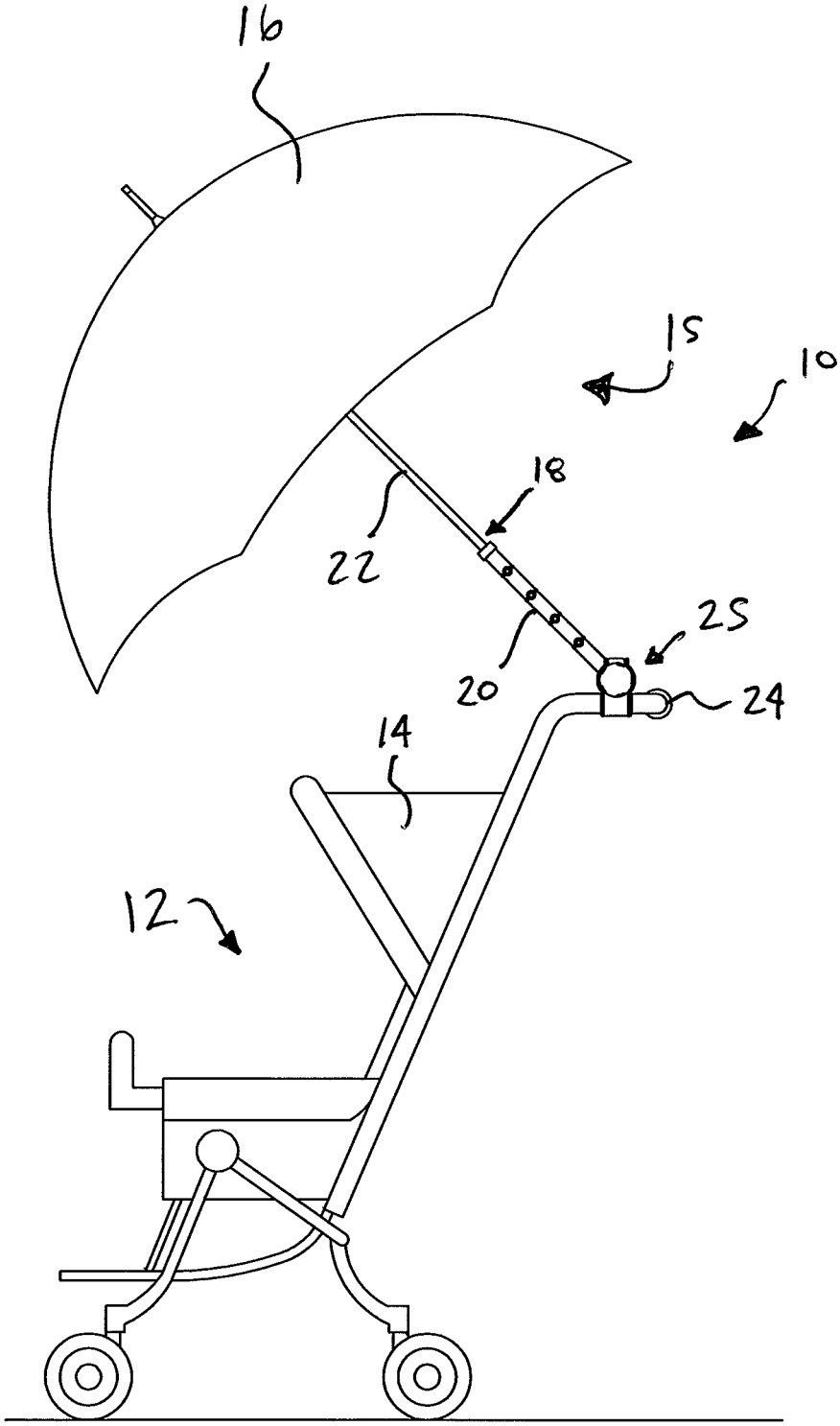
FIG. 2 is a side elevational view of the embodiment of FIG. 2 with the umbrella portion positioned in a different active position.
Figure 3:
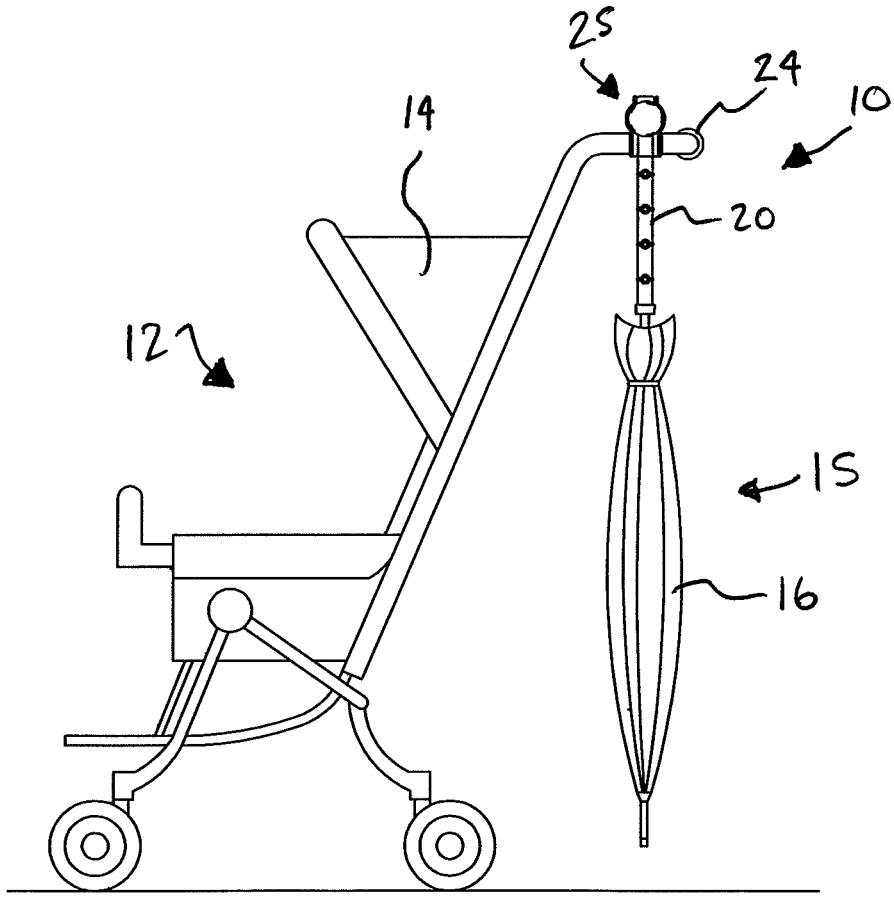
FIG. 3 is a side elevational view of the embodiment of FIGS. 1 and 2 with the umbrella portion positioned in a stowed position.

Referring to the drawings, FIG. 1 depicts an adjustable umbrella assembly according to a non-limiting embodiment of the present invention, generally designated with the reference numeral 10, attached to a conventional folding or collapsible stroller 12. The stroller 12 seats a young child (not shown) who may be protected from rain, wind and cold by a canopy 14 or other suitable rain shield (not shown), such as those commonly available from stroller manufacturers and retail stores carrying strollers and accessories. The umbrella assembly 10, which may also attach to a pram, baby carriage, wheelchair, or other suitable device, includes an umbrella portion 15 having a cover 16 and a telescoping shaft 18. Telescoping shaft 18 includes a lower section 20 and an upper section 22 slidable within lower section 20. Lower section 20 of shaft 18 is coupled to an upper portion of the frame 23 of the stroller 12, preferably at or about a handle portion 24 by a clamping mechanism 25 as shown in FIGS. 1-3. The clamping mechanism is described in further detail below. It is to be readily appreciated that such positioning of the umbrella assembly 10 protects a caregiver (or other person pushing the stroller) from precipitation or other environmental conditions (e.g., without limitation, sunlight).

As commonly utilized in known umbrella designs, cover 16 is generally formed from a lightweight waterproof or water resistant material, such as nylon, vinyl, canvas or other suitable material used in umbrella manufacture, which is sized and cut to provide a selected diameter for the particular umbrella. Such diameter should be selected to provide rain, wind and precipitation protection for an adult standing underneath. Aside from further details of the telescoping shaft provided below, the remainder of umbrella portion 15 may be fabricated using generally any suitable collapsible umbrella mechanism.

Having thus described an overview of an example embodiment of an umbrella portion 15 according to an embodiment of the invention, an example embodiment of a clamping mechanism 25 will now be described in conjunction with the FIGS., particularly in conjunction with the exploded view of FIG. 4. The example clamping mechanism 25 of FIG. 4 serves two general functions: first it serves to couple umbrella portion 15 to stroller 12, and second it serves to allow for the adjustment of the relative positing of umbrella portion 15 with respect to stroller 12.

In providing the first function, clamping mechanism 25 includes a first clamp member 30 having a threaded shaft 32 extending through a portion thereof such that a first end 34 of threaded shaft 32 protrudes from a first side of clamp member 30, and an opposite second end 36 protrudes from an opposite second side of clamp member 30. A second clamp member 38 includes a pivot pin 40 that interlocks with a corresponding portion of first clamp member 30, creating a hinge point that allows the two clamp members 30, 38 to cooperatively engage, and be tightened, on a selected portion of the stroller 12, preferably at or near the handle portion 24. The two clamp members 30, 38 are tightened by turning a stroller tightening knob 42 threadedly disposed on threaded shaft 32 at or near first end 34. Stroller tightening knob 42 is preferably formed from an inner half 44 and an outer half 46 that are fused together. A threaded nut 48 is preferably installed in the tightening knob 42 during manufacture. Preferably, such elements are made from a composite material such as reinforced polycarbonate (or other type of composite) or other suitable material. In use, the tightening knob 42 opens and closes the clamp formed by the first and second clamp members 30, 38 to secure the umbrella assembly 10 to the stroller 12. Preferably, the tightening knob 42 is manufactured to only loosen a selected amount, and thus cannot be removed from the threaded shaft and potentially lost by a user.

Preferably, one or both of clamp members 30, 38 are provided with a number of generally small grip protrusions 50 molded into the concave clamp area (not numbered) thereof. The grip protrusions 50 allow the clamp formed by the first and second clamp members 30, 38 to grip the cushioned (rubber, foam, plastic or metal) handles or other selected portion of a stroller.

In a preferred embodiment, the surface of the outer half 46 of tightening knob 42 contains an embossed star logo to differentiate the tightening knob from the positioning knob (discussed below) for the user.

In providing the second function, clamping mechanism 25 includes a positioning knob 60 formed from inner and outer halves 62 and 64, respectively. Similar to tightening knob 42 previously discussed, such elements are preferably made from a composite material such as reinforced polycarbonate (or other type of composite) or other suitable material. A threaded nut 66 is preferably installed in the positioning knob 60 during manufacture. When the positioning knob 60 is tightened on threaded shaft 32 at or about second end 36, the umbrella portion 15 is held in the chosen position. The user is able to adjust the angle of the umbrella portion 15 relative to the stroller 12 depending on the direction of the rain and/or for the placement of the mounting device on the particular stroller. FIG. 1 shows an example of the umbrella portion 15 positioned generally parallel to the ground. FIG. 2 shows an example of the umbrella portion 15 positioned at roughly a 45 degree angle with respect to the ground. It is to be appreciated that such particular positioning as shown in FIGS. 1 and 2 is shown for example purposes only and is not meant to be limiting upon the scope of the present invention and that the umbrella portion 15 may be positioned at other angles other than those shown. As shown in FIG. 3, the user can also turn the umbrella 180 degrees from the position shown in FIG. 1 so that the umbrella portion 15 can be stored on the stroller 12 in a downward position when not in use. Preferably, the positioning knob 60 is manufactured to only loosen a selected amount and thus cannot be removed from the threaded shaft and potentially lost by a user.

Figure 4:
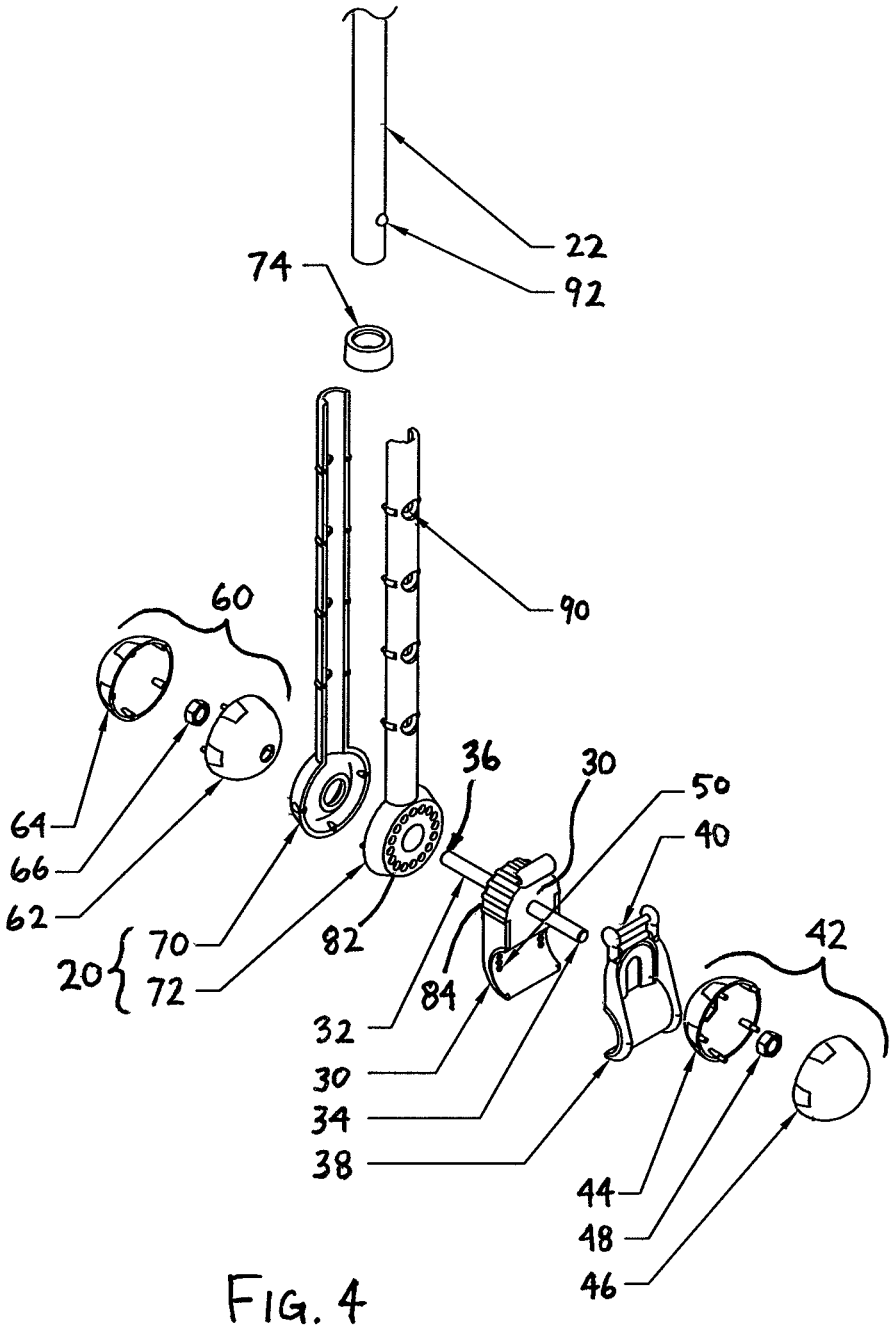
FIG. 4 is an exploded view of the mounting portion of a device according to a non-limiting embodiment of the present invention.

Continuing to refer to FIG. 4, lower section 20 of shaft 18 is preferably formed from first and second halves 70 and 72, respectively. During manufacture, first half 70 and second half 72 are fused together with a shaft ring 74 to create a hollow cylindrical tube in which the upper section 22 of telescoping shaft 18 can then be inserted. Shaft ring 74, which is fused to the upper end of the two halves 70, 72 reinforces the fusing of the two halves and provides a generally smooth transition for upper section 22 to slide therein.

Lower section 20 of telescoping shaft 18 includes a concentric ring portion 80 at the opposite end of the shaft ring 74. The concentric ring portion 80 of second half 72 includes a number of depressed detents 82 arranged in a circular manner. The depressed detents 82 correspond to a number of raised buttons 84 disposed on first clamp member 30. When assembled, each of the number of buttons 84 snap into a corresponding one of the number of detents 82, thus allowing the angle of umbrella portion 15 to be adjusted by loosening, adjusting, and retightening of positioning knob 60.

In the example embodiment shown in FIG. 4, each of the halves 70, 72 of lower section 20 are provided with a number of recessed apertures 90 spaced at generally equal intervals. In a preferred embodiment, such apertures are spaced generally one inch apart, with finger access to allow umbrella height adjustment for users. Upper section 22 of telescoping shaft 18 is fitted with a spring loaded button 92 that is inserted into the lower section 20 of telescoping shaft 18. The button 92 locks into one of the multiple recessed apertures 90 as selected by a user according to user height and preference.

It should be appreciated that an umbrella that attaches to a stroller to provide protection for the user in inclement weather has been described, with reference to preferred embodiments illustrated in the accompanying drawings, but that other modifications may be made to this preferred embodiment. It will be appreciated that the present invention is not limited to those precise embodiments, and that various changes and modifications may be made thereto by one of ordinary skill in the art without departing from the scope or spirit of the invention, which is defined in the following claims.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. An umbrella assembly for providing cover to a user pushing a stroller or similar device, the assembly comprising:

an umbrella having a shaft extending therefrom, the shaft having a button member protruding radially therefrom; and a clamp mechanism having a first portion structured to be coupled to a portion of the stroller and a second portion including a hollow shaft that slidably engages the shaft of the umbrella, wherein the first portion of the clamp mechanism includes a tightening knob that is structured to tighten or loosen the coupling of the first portion and the portion of the stroller, the tightening knob being rotatable about an axis extending through the first and second portions of the clamp mechanism, wherein the second portion of the clamp mechanism is selectively rotatable about the axis extending through first and second portions of the clamp mechanism such that the umbrella may be placed among a plurality of positions, wherein the second portion of the clamp mechanism includes a control mechanism to control the rotation of the second portion about the first portion, wherein the hollow shaft comprises a plurality of apertures disposed therein, each of the apertures being selectively engageable by the button member, and wherein the umbrella is positioned a first distance from the clamp mechanism when the button member is engaged with a first aperture of the plurality of apertures and is positioned a second distance from the clamp member when the button member is engaged with a second aperture of the plurality of apertures.

2. The umbrella assembly of claim 1 wherein the second portion of the clamp mechanism is selectively rotatable with respect to the first portion of the clamp mechanism from a first position to a second position, the second position being about 180 degrees from the first position.

3. The umbrella assembly of claim 1 wherein the control mechanism of the second portion of the clamp mechanism comprises a second knob member that is structured to control rotation of the second portion about the first portion.

* * * * *

UNITED STATES PATENT AND TRADEMARK OFFICE

CERTIFICATE OF CORRECTION

PATENT NO. : 8,439,055 B2
APPLICATION NO. : 13/009124
DATED : May 14, 2013
INVENTOR(S) : Melissa April et al.

It is certified that error appears in the above-identified patent and that said Letters Patent is hereby corrected as shown below:

In the Claim

Column 6, line 51, Claim 1, “through” should read --through the--.

Signed and Sealed this
Third Day of December, 2013

Margaret A. Focarino

Margaret A. Focarino
*Commissioner for Patents of the United States Patent and Trademark Office*